US008668781B2

(12) United States Patent
Cosgrove

(10) Patent No.: US 8,668,781 B2
(45) Date of Patent: Mar. 11, 2014

(54) DISHWASHER LID SEALING ASSEMBLY

(75) Inventor: Matthew Simon Cosgrove, Dunedin (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 887 days.

(21) Appl. No.: 12/601,307

(22) PCT Filed: Jun. 6, 2008

(86) PCT No.: PCT/NZ2008/000133
§ 371 (c)(1), (2), (4) Date: Mar. 3, 2010

(87) PCT Pub. No.: WO2008/150184
PCT Pub. Date: Dec. 11, 2008

(65) Prior Publication Data

US 2010/0170542 A1 Jul. 8, 2010

Related U.S. Application Data

(60) Provisional application No. 60/955,470, filed on Aug. 13, 2007.

(30) Foreign Application Priority Data

Jun. 8, 2007 (NZ) ..... 555755

(51) Int. Cl.
*B08B 3/00* (2006.01)

(52) U.S. Cl.
USPC ..... 134/115 R; 134/200

(58) Field of Classification Search
CPC ..... A47L 15/0084; A47L 15/4263
USPC ..... 134/115 R, 200; 220/221, 305
See application file for complete search history.

(56) References Cited

U.S. PATENT DOCUMENTS

| | | | | |
|---|---|---|---|---|
| 4,278,277 | A * | 7/1981 | Krijgsman | 285/93 |
| 5,755,244 | A * | 5/1998 | Sargeant et al. | 134/46 |
| 6,189,551 | B1 * | 2/2001 | Sargeant et al. | 134/200 |
| 6,491,049 | B1 | 12/2002 | Tuller et al. | |
| 7,152,612 | B1 | 12/2006 | Maunsell et al. | |

(Continued)

FOREIGN PATENT DOCUMENTS

| | | | |
|---|---|---|---|
| EP | 1 661 504 | | 5/2006 |
| WO | WO 2005041740 | A1 * | 5/2005 |
| WO | WO 2006057567 | A1 * | 6/2006 |

*Primary Examiner* — Michael Kornakov
*Assistant Examiner* — Marc Lorenzi
(74) *Attorney, Agent, or Firm* — Clark Hill PLC

(57) ABSTRACT

An appliance having a casing with an open topped tub located within it, a lid structure including a seal for closing and sealing the tub mounted to the casing, the seal sealing with the top edge of the tub and located at or close to the perimeter of the lid structure, the lid structure including a lid center portion and a frame which circumscribes the lid center portion, the appliance including a gasket, connecting the frame to the lid center portion so that at least part of the gasket forms a free body portion between the frame and the lid center portion, the lid center being free-floating relative to the frame, the appliance including a lid structure supporting mechanism connected to the frame to move the lid structure downwards, and if the lid center portion is prevented from moving downwards, the frame can continue to move downwards.

26 Claims, 9 Drawing Sheets

(56) References Cited

U.S. PATENT DOCUMENTS

2003/0205255 A1* 11/2003 DeBoer et al. ..... 134/115 R
2006/0012125 A1* 1/2006 Salameh ..... 277/325
2007/0119485 A1 5/2007 Gunnerson et al.

* cited by examiner

DISHWASHER LID SEALING ASSEMBLY

BACKGROUND OF THE INVENTION

1. Field of Invention

This invention relates to appliances with internal lids for closing and sealing tubs located with the appliances, and in particular this invention relates to a dishwasher that includes an internal wash tub lid and a seal assembly for sealing a wash tub lid onto a wash tub.

2. Description of the Prior Art

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

Automatic dishwashers are well known in the art. The operation of the majority of dishwashers is similar and can be summarised as follows: Dirty dishes are placed in a wash compartment or wash tub. Once the dishes have been placed in the wash tub, the dishwasher is closed. The dishwasher closing action normally also seals the wash tub. When the wash cycle is started, hot water mixed with detergent is sprayed into the tub to clean the dishes. This is followed by a clean water spray to rinse the dishes.

The two most common types of dishwashers are front opening (drop-down door—the door pivoting outwards and downwards about its lower edge) or drawer-style. In drawer-style dishwashing machines, such as the Fisher and Paykel DISHDRAWER®, the wash tub is an open-topped compartment. Dirty dishes to be washed are stacked in racks in the tub. The main body or chassis of the dishwasher includes a tub lid, the tub lid having a perimeter seal. When a user pushes the drawer back into the casing of the dishwasher, a mechanism such as a cam lowers the lid and perimeter seal downwards onto the open top, pressing the perimeter seal onto the perimeter of the tub to close and seal the tub. The cleaning and rinsing water is sprayed upwards into the compartment from a spray arm on the base of the tub. An example of an open-top wash tub and lid sealing arrangement is disclosed in EP 1661504.

One problem that is well-known in the art is that of providing a reasonable or sufficient seal between the lid and the tub, especially during the wash cycle. During the wash cycle, the action of mechanical components such as the spray arm can cause the tub and lid to vibrate, potentially breaking the seal. If the seal is not maintained, water can leak from the wash tub during the wash or rinse cycles. This can cause mess or damage, and be inconvenient to a user.

Furthermore, when open-topped wash compartments or tubs are used, it is easy for a user to inadvertently overload the tub, making the seal between the lid and the tub harder to maintain. For example, if large dishes or cooking pots are placed in the wash tub, a user must ensure that these are positioned so that they do not extend above or overhang the top edge of the tub. This extension or overhang makes it difficult for a seal to be created or maintained around the top edge of the tub, as the lid cannot be pressed fully down onto the rim or edge of the tub to create the seal between the two. It can be difficult to detect or correct an overload situation when the tub is loaded in such a manner that a seal between the lid and the tub is initially created, but where the load is positioned such that movement and vibration during the wash cycle can act to break the seal.

One embodiment of the design disclosed in and shown in EP1661504—specifically, the arrangement shown in FIG. 39 of EP1661504—is intended to overcome this problem by providing a separate seal support carrier 252, interposed between the periphery or edge of the lid 217 and the seal. The lid 217 is attached to the inner surface of the top of the dishwasher casing or chassis. The main body or planar horizontal upper portion of the lid 217 remains stationary, attached to the dishwasher frame or chassis. As shown in FIG. 39, the seal is attached to the support carrier 252, with the support carrier 252 and the attached seal lowered onto the upper edge or periphery of the tub to create a seal between the tub and the lid. This arrangement can help to overcome the sealing problems outlined above. However, it is necessary for the seal carrier to extend (to form the seal) and retract (when the dishes are unloaded and the tub is withdrawn from the chassis) for every wash cycle. This extension/retraction cycling can fatigue the support carrier 252.

It is also desirable to minimise the amount of rigid structure contained in the chassis, which is used to hold the lid and seal in place relative to the tub. Rigid structure between the tub and the chassis can provide a noise transmission path from the tub to the casing, and it is desirable to minimise as far as possible the potential noise transmission path(s), as this can be disruptive or disturbing to a user. This can also add cost, weight and complexity to a dishwasher structure.

It can be seen that a mechanism which helps to reduce the extension cycles of the seal and the associated structure is desirable. A structure which helps to reduce the number of potential noise transmission paths from the wash tub, by minimising the amount of rigid structure on the casing, which also has the benefit of simplifying the construction and avoiding the need for additional overall weight is also desirable.

SUMMARY OF THE INVENTION

It is an object of the present invention to provide a dishwasher lid, which goes some way towards overcoming the problems outlined above, or which will at least provide the public with a useful choice.

Accordingly the invention may broadly be said to consist in an appliance comprising:

a casing, at least one open topped tub, located within said casing in use, a lid structure including a seal for closing and sealing said tub, said lid structure mounted to the inner surface of the top of said casing, said seal adapted to form a seal with the top edge of said tub in use, said seal and located at or close to the perimeter of said lid structure, said lid structure including a lid centre portion and a frame, said frame circumscribing said lid centre portion, said appliance further including a gasket, said frame connected to said lid centre portion by said gasket in such a manner that at least part of said gasket forms a free body portion between said frame and said lid centre portion so that said lid centre is free-floating relative to said frame, said appliance further including a lid structure supporting mechanism connected at least to said frame in such a manner that said lid structure can be moved downwards by said lid structure supporting mechanism, and if said lid centre portion is prevented from moving downwards by an object located in said tub, said frame can continue to move downwards.

Preferably said appliance is a dishwasher including a wash system for washing dishes contained therein, said cabinet having a front side with an opening formed therein, said dishwasher further including a tub support mechanism, supporting said tub and configured to allow said tub to move from a position where said tub is located fully within said casing, to a position where said tub is at least partially located outside said casing.

Preferably said frame includes connection points adapted to connect said frame to a lid supporting mechanism in use.

Preferably said gasket includes an integral outer sealing portion which forms said seal in use.

Preferably said outer sealing portion includes an upper sealing lip and a lower sealing lip.

Preferably said seal is formed by an outer sealing portion that is separate from said gasket and is separately attached to said frame.

Preferably said outer sealing portion includes an upper sealing lip and a lower sealing lip.

Preferably said free body portion has a generally rectangular cross-section.

Preferably said free body portion is formed as a bellows diaphragm.

Preferably said frame and said gasket are sized and connected such that said frame overlaps the outside edges of said gasket, said frame including a ledge portion extending inwards, said frame connected to said gasket at least at said ledge portion.

Preferably said lid structure also includes a frame stiffener, attached at or close to the outer part of said frame on at least one side of said frame, said frame stiffener formed as a u-channel section, aligned sideways and connected to said outer part of said frame with the base of said u-channel section covering the outermost part of said frame.

Preferably said lid cover portion is a flat rectangular plate that includes a downwards-facing perimeter edge wall angled outwards, and said gasket has the form of a hollow rectangle, said gasket connected to said lid portion at said edge wall.

Preferably said gasket and said sealing portion are made from silicon rubber.

Alternatively said gasket and said sealing portion are made from a thermoplastic elastomer.

Preferably said lid assembly also includes a local stop, connected to and extending outwards from said lid centre portion, the outer part of said local stop at least substantially overlapping above said gasket.

Preferably said lid structure portion includes a sound deadener.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The term 'comprising' as used in this specification means 'consisting at least in part of', that is to say when interpreting statements in this specification which include that term, the features, prefaced by that term in each statement, all need to be present but other features can also be present.

BRIEF DESCRIPTION OF THE DRAWINGS

Preferred forms of the present invention will now be described with reference to the accompanying drawings in which.

DETAILED DESCRIPTION OF THE PREFERRED EMBODIMENTS

Figure 1:
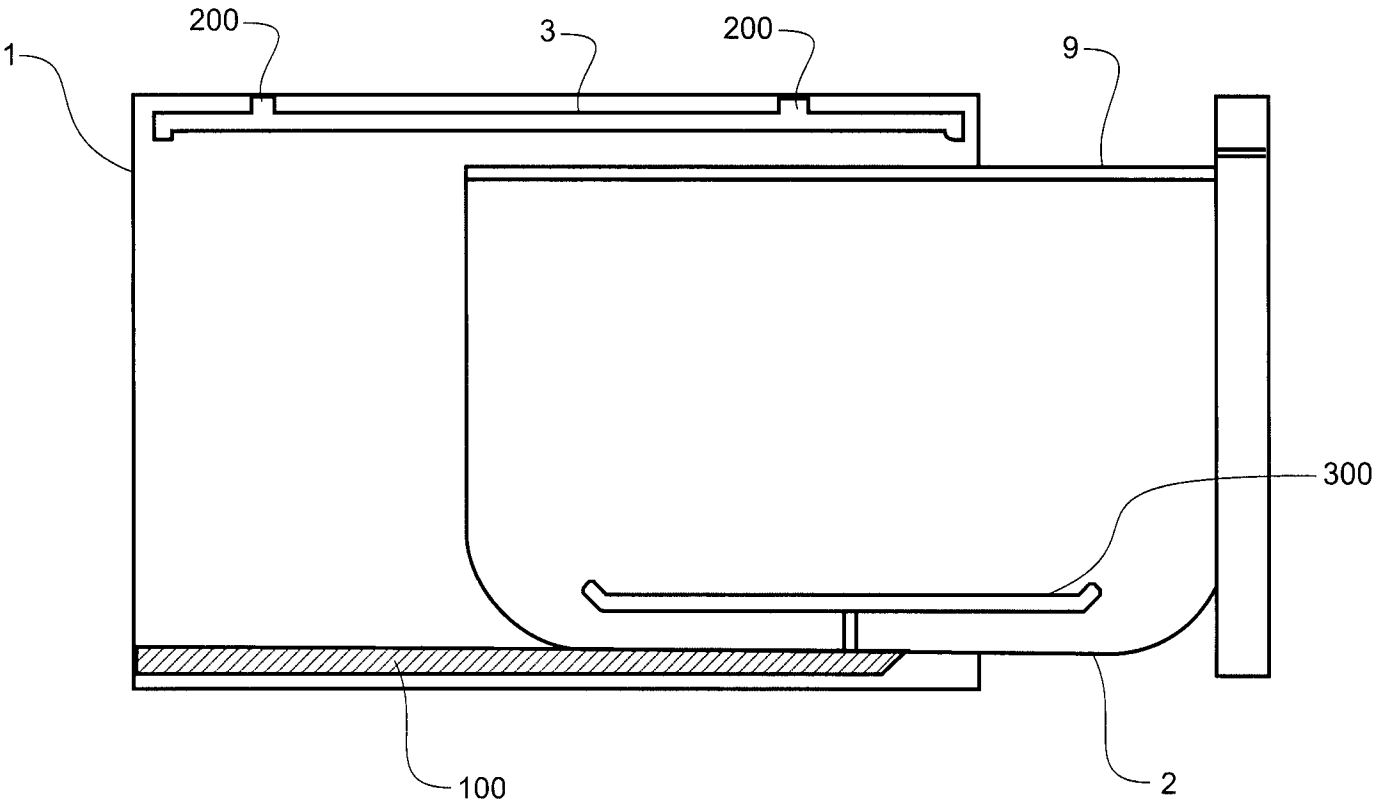
FIG. 1 shows a schematic cross sectional side view of a drawer-style dishwasher that includes a casing, a horizontally moving wash tub, and a lid structure contained in the upper part of the casing, which in use closes and seals the wash tub.

While the invention is susceptible to embodiment in different forms, specific embodiments are shown in the drawings, and described in detail. The present disclosure is to be considered an exemplification of the principles of the invention, and is not intended to limit the invention to that as illustrated and described herein.

This invention is applicable for appliances which have internal lids for closing and sealing a tub or compartment located inside the appliance in use. The preferred embodiments will be described in relation to a dishwasher. However, it should be noted that there are other household appliances to which the invention could be applicable—for example a freezer with an internal bin or tub which is required to be sealed.

A schematic cross-section of a dishwasher assembly, which includes a cabinet or casing 1, a wash tub 2 which moves in and out of the casing 1 horizontally, and a lid structure, generally shown as lid structure 3, is shown in FIG.

1. The tub 2 is supported in the casing 1, and is moved in and out of the casing 1 horizontally, by a tub support mechanism 100. The tub support mechanism could for example be a set of rails, a horizontal scissor mechanism, or any other appropriate mechanism. The tub 2 can be moved from a position outside the casing 1, where it can be accessed by a user for loading and unloading, to a position fully within the casing 1, for washing the dishes contained in it. A wash mechanism is shown generally as wash mechanism 300 in FIG. 1. The wash mechanism is for example a rotating spray arm or similar. The tub support mechanism 100 is generally shown underneath the tub 2 in FIG. 1, but could for example be a pair of rails and runner mounted one each side of the tub 2.

Figure 2A:
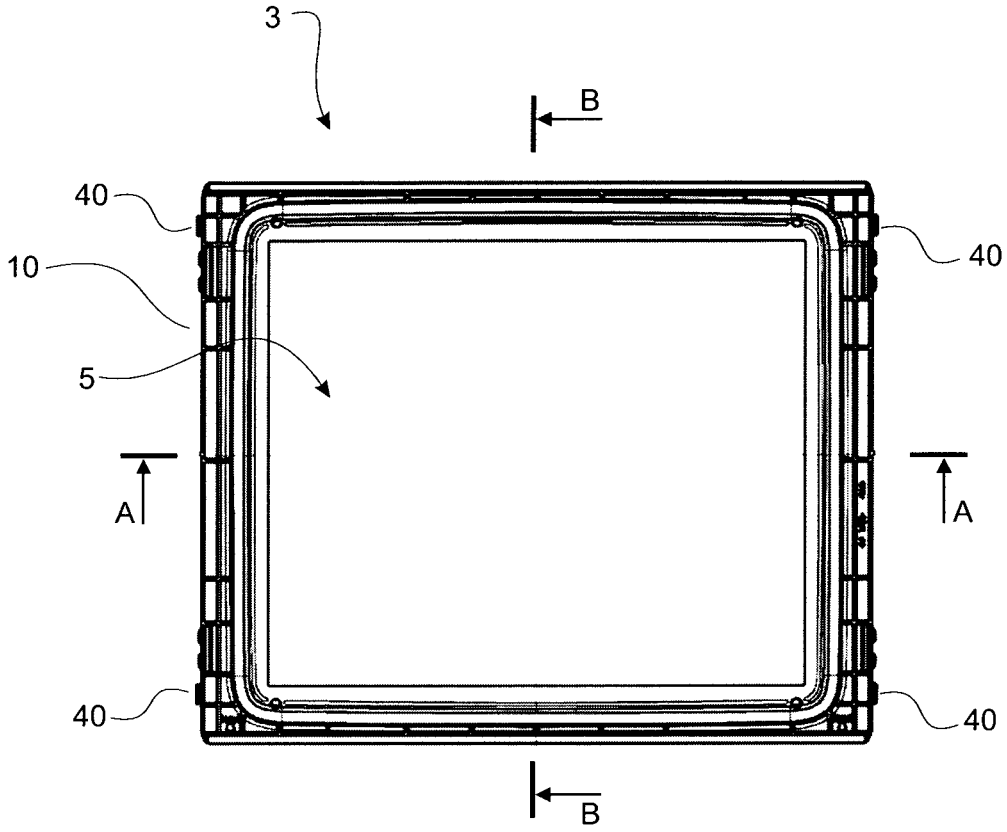
FIG. 2*a* shows a plan view of the lid structure of FIG. 1, with a lid centre portion and a surrounding frame shown.

In the preferred embodiment, the lid structure 3 is located inside the casing 1, just underneath the top inner surface, and mounted on or to the top inner surface. In the preferred embodiment, the lid structure 3 has an outer perimeter rectangular in plan view, as shown in FIG. 2*a*, and is sized and shaped to match a form of tub 2 which is rectangular or cuboid with an open lop. The tub 2 has a top edge 9 or top surface 9 around the perimeter of its open top. The lid structure 3 is mounted or connected to the casing 1 so that the lid structure 3 can be raised and lowered—the lid structure 3 and casing 1 are adapted so that the lid structure 3 can be moved at least vertically. The mounting mechanism for supporting and lowering the lid structure 3 onto the tub 2 is any suitable lid support mechanism known in the art, or any suitable mechanism which may be developed. For example, a camming mechanism, a scissor mechanism, hydraulic pistons, a worm drive driven by an electric motor, or similar The lid structure supporting mechanism or mounting mechanism is shown generally as item 200 on FIG. 1. The lid structure 3 is formed from three main parts—a lid cover or lid centre 5, a gasket member or gasket 25 which in the preferred form also includes an outer sealing portion 25*d*, and a frame 10. These are described in detail below.

Lid Cover

The lid structure 3 includes a central cover portion or lid centre 5. It should be noted that 'central' does not mean that this portion has to be exactly centred, merely that the cover portion is located inside an outer perimeter of a larger overall structure. The lid centre 5 generally has the form of a rectangular plate (plan view), with a downwards-facing perimeter edge wall 12, the inner face of the edge wall 12 angled outwards slightly—towards the walls of the casing 1 in use. The preferred form of lid centre 5 is sized so that it is slightly smaller than the tub 2 that it will be used with. That is, the side, front and rear sides are shorter than the corresponding sides of the tub 2. The lid centre 5 of the preferred form also includes a sound deadener 20, which in the preferred form is a bitumen layer covering nearly the entire upper surface of the lid centre 5, except the edges of the lid centre 5.

Gasket and Seal

The lid structure 3 includes a gasket 25. In the most preferred form, the gasket 25 also includes an integral outer sealing portion 25*d* adapted to seal against the edge 9 of the tub 2 in use. That is, the outer sealing portion 25*d* is integrally formed with the gasket 25. When the tub 2 is located in the wash position (that is, fully within the casing 1), the outer sealing portion 25*d* contacts and seals against the open top of the tub 2, so that the lid structure 3 closes and seals the tub 2. The outer sealing portion will be described in detail below.

Figure 6:
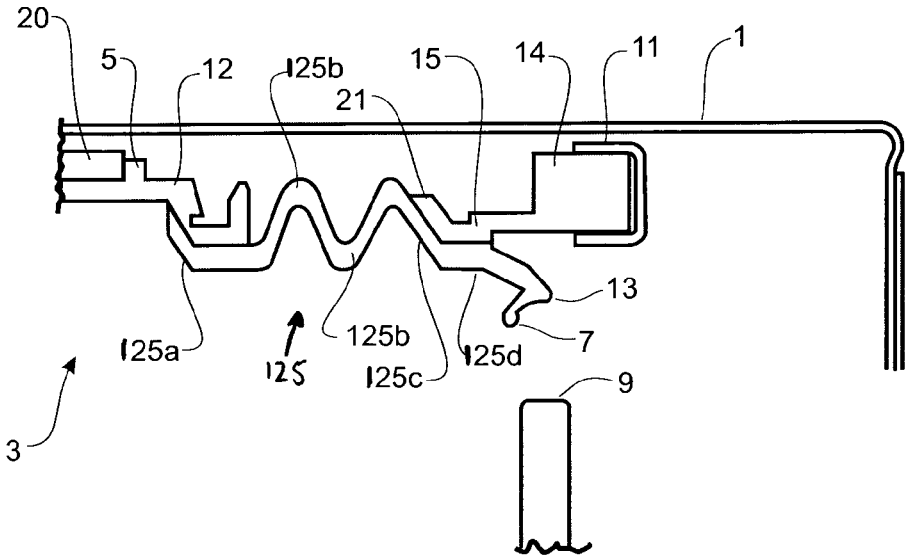
FIG. 6 shows a cross section of the right hand side of lid structure which includes an alternative form of gasket and seal structure and frame, the overall form of the lid structure generally the same as that shown in FIG. 3*b*, with the lid structure shown mounted in a dishwasher, this figure also showing the casing of the dishwasher, and one wall of the wash tub of the dishwasher assembly.
Figure 7:
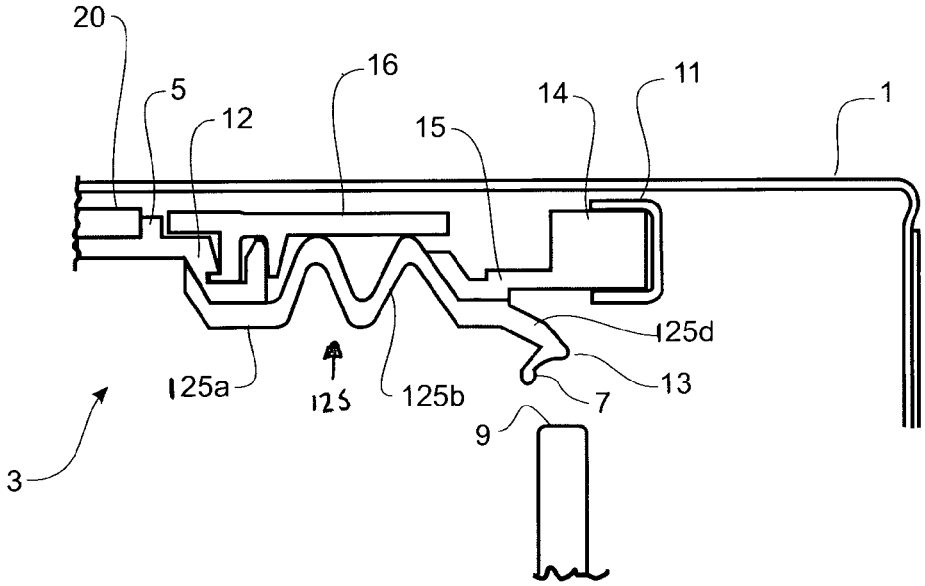
FIG. 7 shows the lid structure and other items of FIG. 6, with a centre support or local stop also shown, mounted above the sealing assembly.
Figure 9:
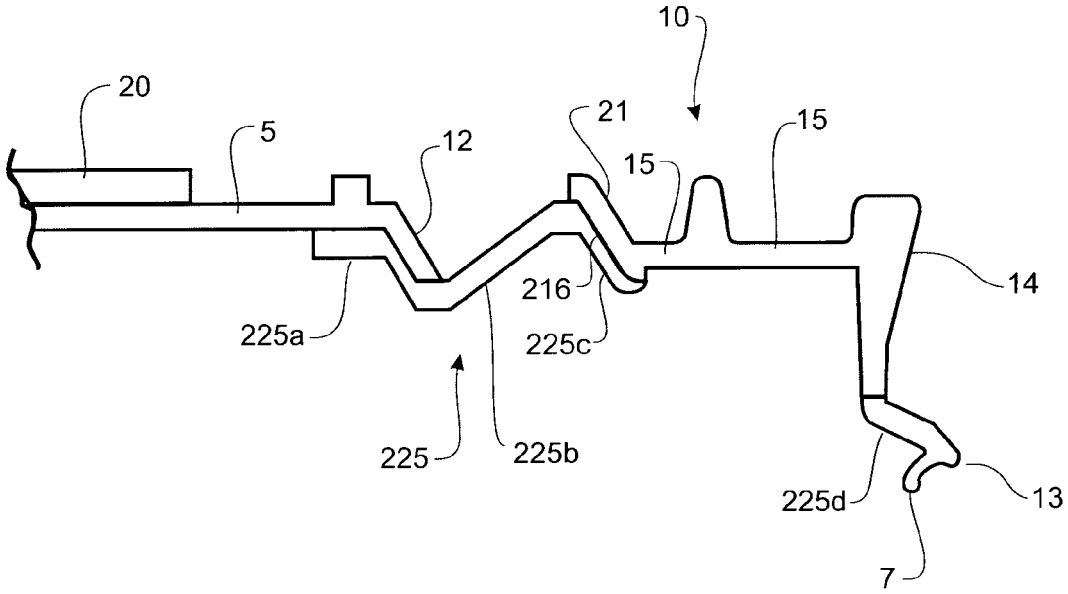
FIG. 9 shows a similar view to detail A of FIG. 3*a*, showing detail of another alternative form of gasket and seal structure and the right hand side of the rigid outer frame.

The preferred form of gasket 25 which includes the integral outer sealing portion 25*d* is shown in FIGS. 3 and 4. An alternative form of the gasket 125 (including an outer sealing portion 125*d* the same as outer sealing portion 25*d*) is shown in FIGS. 6 and 7, along with some additional structure that may be used as part of the lid structure 3. Yet another alternative form of gasket 225 is shown in FIG. 9, the sealing portion 225*d* formed separately from the gasket 225 in this other alternative embodiment.

Figure 2B:
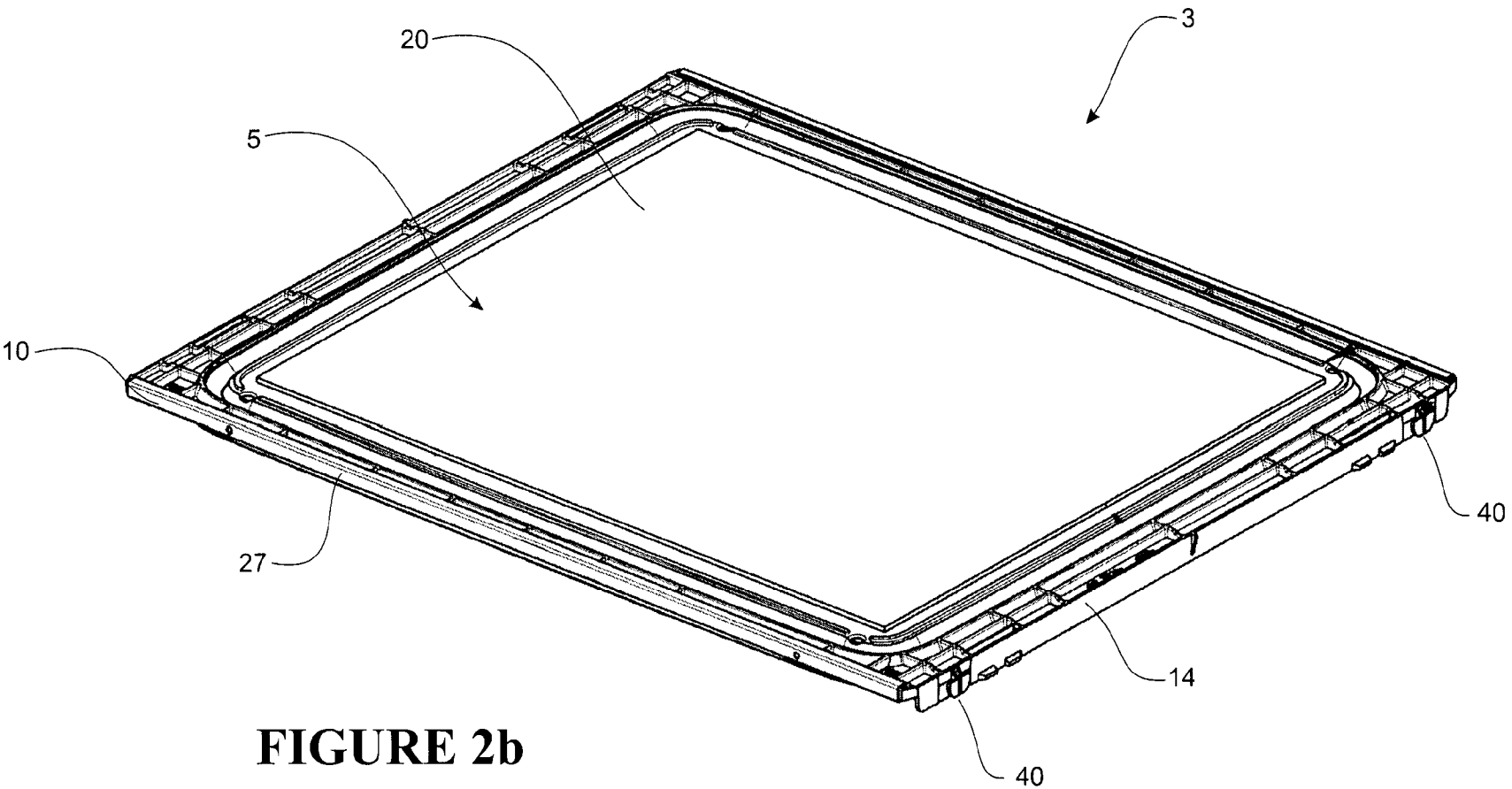
FIG. 2*b* shows a perspective view of the lid structure of FIG. 1 and FIG. 2*a*.
Figure 3B:
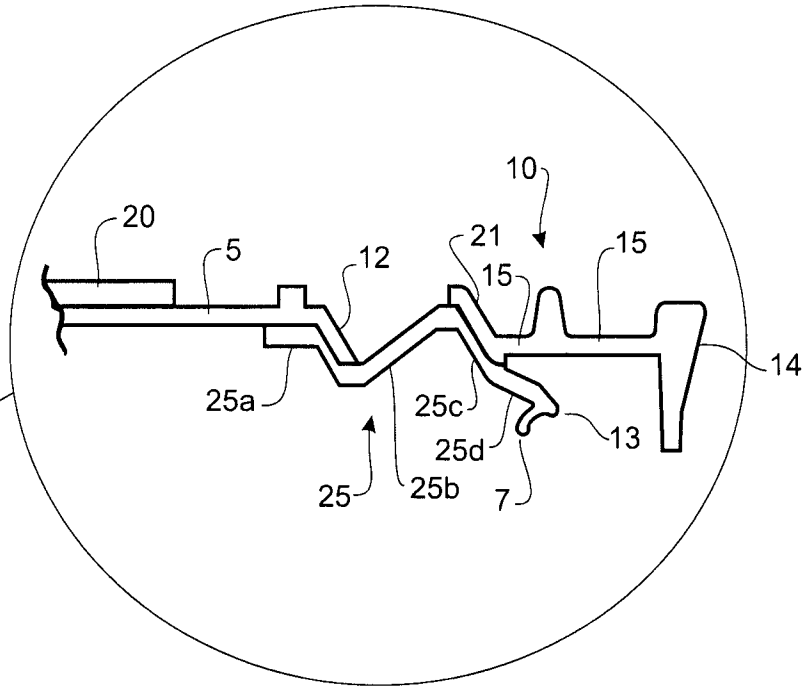
FIG. 3*b* shows a close up of detail A of FIG. 3*a*, showing further detail of the edge of the lid centre portion, the preferred form of gasket and seal structure and the right hand side of the rigid outer frame.
Figure 3A:
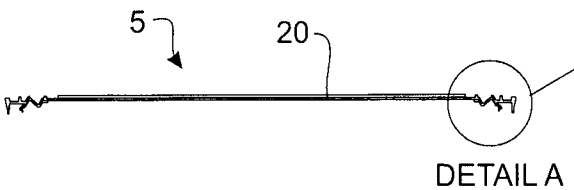
FIG. 3*a* shows section A-A from FIG. 2*a*, with detail of the lid structure shown, including the lid centre portion, the right hand and left hand sides of the rigid outer frame, and a preferred form of gasket and seal structure between the centre portion and the frame.

A cross-section of one side of the lid 3 is shown in FIG. 3*a*, with detail of the gasket 25 of the preferred form shown in FIG. 3*b*. The cross-section of FIG. 3*a* is taken along a line that bisects the lid structure 3 across one of the two bi-section axes—section A-A from FIG. 2. The bi-section line A-A runs from one side of the lid structure 3 to the other—perpendicular to each side.

The gasket 25 also has a generally rectangular outline in plan view, with a hollow centre. The length of the edges of the gasket 25 are generally sized to correspond to the sides of the tub 2—the sides of the gasket 25 are slightly larger than those of the lid centre 5. The inner cut-out portion of the gasket 25 is smaller than the plan outline of the lid centre 5, so the edges of the lid centre 5 overlap the cut-out portion of the gasket 25, with the outer sides or edges of the gasket 25 overlapping outside the surface area or coverage of the lid centre 5. This ensures that at least part of the gasket 25 passes outwards from the edges of the lid centre 5. As can be seen from the cross-section of FIG. 3*b*, the most preferred form of the gasket 25 can be divided into four main portions 25*a*, 25*b*, 25*c* and 25*d*, each of generally equal size or cross-section, the four main portions part of one integrated whole item—gasket 25. The inner portion 25*a* of the gasket 25 is connected to the lid centre 5 on the inner face and lower surface of the edge wall 12, and also slightly inwards from the edge wall 12 on the lower surface of the lid centre 5. The next portion of the gasket 25 outwards from the lid centre 5 is free portion 25*b*, or free body portion 25*b*, which passes outwards from the edges of the lid centre 5, unsupported except by the neighbouring portions 25*a* and 25*c* each side. That is, the free body portion 25*b* of gasket 25 is unconnected (or not directly connected) to the lid centre 5 and the frame 10. The free body portion 25*b* is indirectly connected to the lid centre 5 and the frame 10 by its neighbouring portions—inner portion 25*a* and frame connection portion 25*c*. The free body portion 25*b*, outside the perimeter of the lid centre 5, is in alternative embodiments constructed as a bellows diaphragm, as shown in the variant 125*b* of FIGS. 6 and 7 (it should also be noted that portion 15 of the frame 10 is in the alternative form shown in FIGS. 6 and 7 connected at the lower edge of the side section 14 of the frame 10, although these two features do not have to be combined to form the alternative form). However, in the preferred form, free body portion 25*b* is generally rectangular in cross-section as it is shown in the embodiments of FIGS. 3 and 4.

Portion 25*c* acts as a frame connection portion to connect the frame 10 directly to the gasket 25 and therefore connect the frame 10 indirectly to the lid centre 5. In the most preferred form, portion 25*c* connects between the free body portion 25*b*, and the outer sealing portion 25*d*, which will be described in further detail below.

The gasket 25 is made from rubber, silicon, a thermoplastic vulcanizate (IPV) material (also known as a thermoplastic elastomer) or any other suitable flexible waterproof material, and is manufactured so that it has a degree of stiffness or rigidity, sufficient to at least allow it to keep its shape when not supported. If the alternative form of free body portion 125*b* is used, it is formed as a bellows diaphragm, as shown in the alternative form of FIGS. 6 and 7, it has a concertina, wave or Z-cross-section.

Frame

As outlined above, the lid structure 3 also includes a rigid frame 10, attached directly to the gasket 25 via frame connection portion 25*c* of the gasket 25, the frame 10 abutting and connected to the top surface of the gasket 25. The frame 10 overlaps the outer edges of the gasket 25. In plan, the frame 10 is a hollow rectangle, which in plan view circumscribes or surrounds the lid centre 5, with the gasket 25 located between the lid centre 5 and the frame 10. In the most preferred embodiment, the frame 10 lies in the same plane as the lid centre 5 when not acted on by an external force. However, the frame 10 could lie outside the horizontal plane of the lid centre 5. Also, the inner perimeter of the frame 10 could lie within the outer perimeter of the lid centre 5. The frame 10 has left and right-hand sides, and front and rear sides. A side-side cross-section of the preferred form of lid centre 5, the gasket 25 and the frame 10 is shown in the cross-section A-A (see FIG. 3*a*). Detail of the right-hand side or edge of the lid structure 3 of this cross-section is shown in the 'detail A' view shown in FIG. 3*b*. When viewed from the front of the lid structure 3, each side of frame 10 includes a main portion 14. In the preferred embodiment of FIG. 3*b*, the main portion 14 is rectangular in cross-section along the majority of its length. It should be noted that Section A-A is taken through a supporting rib which extends outwards from the side of main portion 14, giving the partly wedge shaped appearance, with the upper portion thicker than the lower portion, the upper portion tapering inwards on the outer side, the lower portion having parallel sides. A ledge portion 15 projects horizontally inwards from main portion 14, connecting to the main portion 14 close to the top of the inner surface of the main portion 14 for the preferred embodiment (and as described above, for the alternative embodiment of FIGS. 6 and 7, connecting close to the bottom of the inner surface of the main portion 14). An inner connection wall 21 extends from the inner edge of the ledge portion 15, the inner connection wall angled upwards and inwards slightly—towards the lid centre 5: In the most preferred form, the inner connection wall 21*a* is aligned with its inner face parallel to the outer face of the edge wall 12. In use, the inner surface of the inner connection wall 21*a* is connected to the top surface of the frame connection portion 25*c* of the gasket 25 in order to connect the gasket 25 to the frame 10. As can be seen in FIGS. 3*b*, 6 and 7, the top surface of the connection portion 25*c* is also in contact with and connected to the underside of the ledge portion 15. When read in this specification, for the purposes of determining connection and where it would be appropriate to do so, the connection wall 21*a* should be read as being an extension to, and forming part of, the ledge portion (i.e. items 15 and 21*a* should be read as one item where it would be appropriate to do so). The frame 10 is sized and connected to the gasket 25 in such a manner that the frame 10 slightly overhangs the outer edge of the gasket 25. The frame 10 and the lid centre 5 are only connected via the gasket 25.

Figures 4A, 4B:
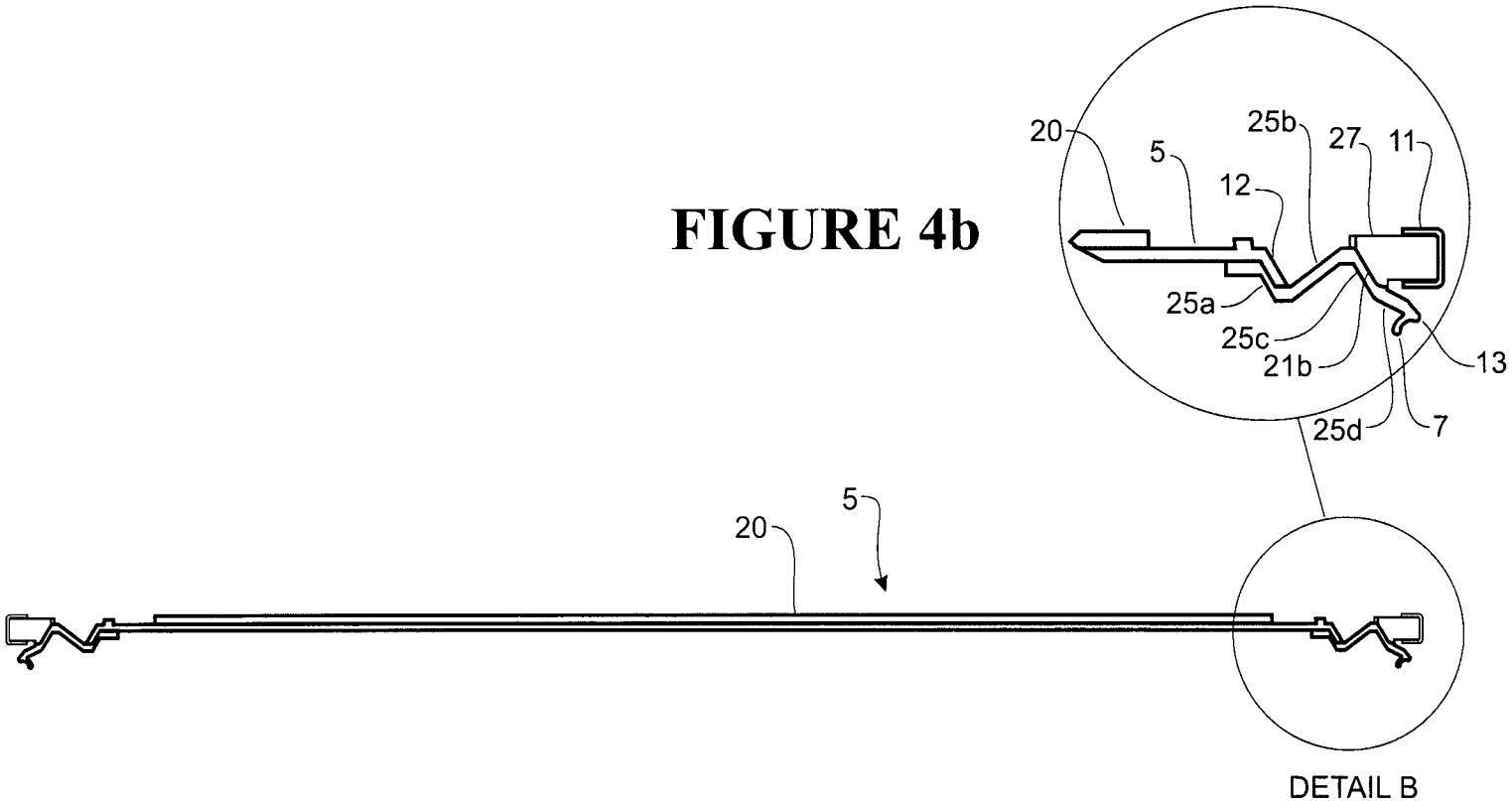
FIG. 4*a* shows section B-B from FIG. 2*a*, with detail of the lid structure shown, including the lid centre portion, the preferred form of gasket and seal structure, and the front and rear edges or sides of the rigid outer frame shown in FIGS. 3*a* and 3*b*.
FIG. 4*b* shows a close up of detail B of FIG. 4*a*, showing detail of the front part of the lid centre portion, the preferred form of gasket and seal structure and the front edge or side of the rigid outer frame.
Figure 5:
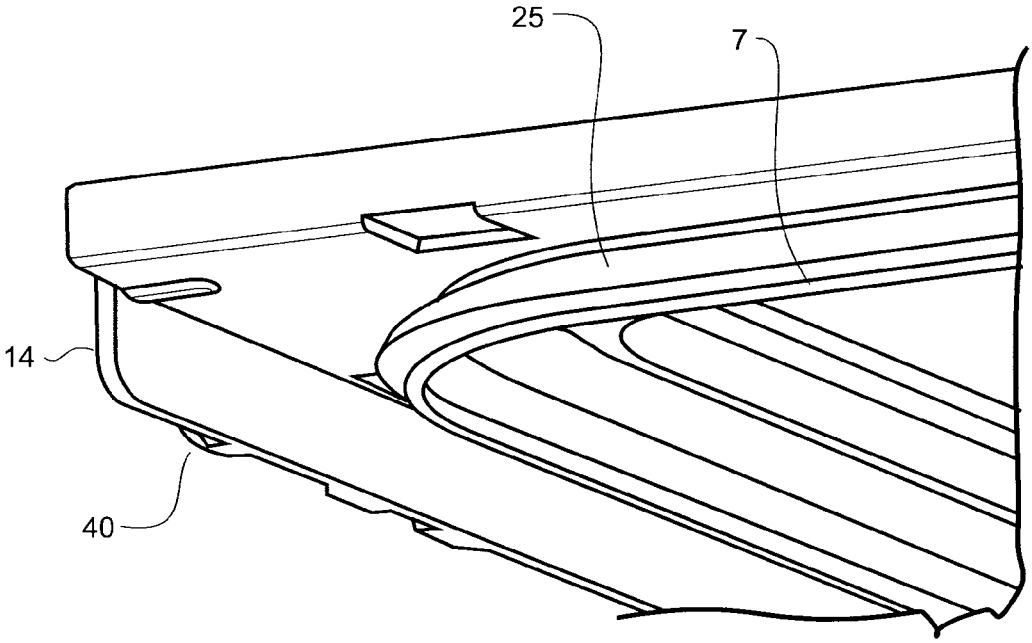
FIG. 5 shows a close up perspective view from underneath of one corner of the lid structure of FIG. 3 or 4, with the left hand side of the rigid frame shown on the left of the figure, and the front side of the rigid frame shown at the front.

The structure of the frame 10 is similar but not exactly the same when cross-section B-B is viewed—i.e. a cross-sectional view from the side of the frame 10. This view is shown in FIG. 4*a*, with detail of the front edge of the lid centre 5, the gasket 25 and the front portion of the frame 10 shown as 'detail B' in FIG. 4*b*. The structure of frame 10 in this view differs from that described for the right-hand side portion of 'detail A' in that the main portion 14 and the horizontal ledge 15 have been replaced by a solid rib 27, which has a generally rectangular cross-section, with the inner face or surface of the solid rib 27 aligned at an angle to form an inner connection surface 21*b*, again preferably parallel to the outer surface of the edge wall 12. It can be seen that the inner face 21*b* is equivalent to the ledge portion 15, or the ledge portion 15 and the connection wall 21*a* together. Where it would be appropriate when reading the specification to exchange these terms or read one for the other, these terms should be read as interchangeable.

It can be seen that the lid centre 5 is free-floating relative to the frame 10.

Outer Sealing Portion

The preferred form of seal 25 includes an outer sealing portion 25*d*, which extends outwards from frame connection portion 25*c* of gasket 25. Outer sealing portion 25*d* is free-standing or free-hanging in that in the most preferred form it is only connected to the rest of the lid structure 3 via its integral connection to the frame connection portion 25*c* on its inner part. It should be noted that although in the most preferred form the sealing portion 25*d* is an integral part of the gasket 25, it does not have to be a part of, or associated with, the gasket 25. That is, the sealing portion 25*d* could in alternative embodiments be a completely separate item, independently connected to the frame 10. This arrangement is shown in FIG. 9, for the other alternative form.

In the preferred form, the outer end of the sealing portion 25*d* is double-lipped, with a lower sealing lip 7 and an upper sealing lip 13. The lower sealing lip 7 is a lip that extends inwards and downwards. The upper sealing lip 13 locates onto the top edge 9 of the tub 2 in use. The lower sealing lip 7 and the upper sealing lip 13 are shaped so that in cross-section there is a notch or recess between the two. This recess ensures a more effective seal.

In the preferred form, as the sealing portion 25*d* is an integral part of the gasket 25, the sealing portion 25*d* is also made from rubber, silicon or any other suitable flexible waterproof material, and is manufactured so that it has a degree of stiffness or rigidity, sufficient to at least allow it to keep its shape when not supported.

Frame Stiffeners

The preferred embodiment of the lid structure 3 also includes frame stiffeners. Each frame stiffener 11 is a U-channel section, turned sideways and attached to the outside of the solid rib 27, on the front edge and the rear edge of the frame 10, as shown in FIGS. 4*a* and 4*b*. The frame stiffeners 11 are attached to the frame 10 in such a manner that the base of the u-section covers the outermost part—the edge or face—of the frame 10, and the side walls of the U-section at least partially cover the upper and lower surfaces of the solid blocks 27 of the frame 10.

It should be noted that the total overall size of the area covered by the lid centre 5 is considerably greater than that covered by the gasket 25 and the frame 10. The gasket 25 and the frame 10 only cover the outermost portions of the open top of the tub 2—the greatest portion of the open top of the tub 2 is mostly covered and closed by the lid centre 5 in use.

General Use

When a user opens and closes the dishwasher, by pulling and pushing the drawer of the dishwasher horizontally inwards and outwards from the casing 1, the tub 2 also moves inwards and outwards from the casing 1. When the drawer is open, and the tub 2 is outside the casing, the lid structure 3 is located just below the inner top surface of the casing 1. When a user pushes the drawer and tub 2 into the casing 1, the lid structure 3 is lowered onto the tub 2 by the lid supporting mechanism 200 as described above, so that the open top of the tub 2 is closed and the lower sealing lip 7 and upper sealing lip 13 seal against the top edge 9 of the tub 2. In the preferred embodiment, the frame 10 is connected to the raising/lowering lid support mechanism at by connections 40 or yoke connection points 40 located on the sides of the frame 10 (i.e. on the outside surface of the main portion 14), towards the corners of the lid structure 3, as shown in FIG. 2*b*. The lid centre 5 is not connected to the lid supporting mechanism, except indirectly via the gasket 25. The lid centre is free-floating relative to the frame 10.

If the tub 2 has been loaded by a user so that the items to be washed are all located fully within the tub 2, and do not overhang the upper edge 9 of the tub 9, the lid centre 5, the free body portion 25*b*, and the frame 10 (and stiffener 11) will all be lowered onto the top of the tub 2, aligned in generally the same horizontal plane across the top of the tub 2. The lid centre 5 and free body portion 25*b* close the tub 2 and the pair of sealing lips 7, 13 seals the lid structure 3 against the tub 2. It can be seen that in normal usage conditions, the gasket 25 will not be required to extend or stretch at all. If the tub 2 is overloaded—that is, if plates or other items have been loaded into the tub 2 so that the top parts of these items protrude above the top edge 9 of the tub 2, then part of the lid 3, usually part of the lid centre 5, will contact these items as it descends into position. The lid centre 5 will therefore be prevented from descending any further. However, the free body portion 25*b* is able to rotate or pivot downwards around its connection to the inner portion 25*a* and if necessary extend (stretch). This allows the frame 10 to continue travelling downwards, independently of movement or non-movement of lid centre 5. Even if the lid centre 5 is blocked and held in position, the frame 10 can continue to move vertically. This allows the sealing portion to make good contact with the top edge 9 of the tub 2 to create the necessary seal. As the free portion 25*b* is not required to stretch or extend in normal usage conditions, it is much less likely to fatigue than a seal or gasket which is required to stretch or extend as part of its normal operation.

Figure 8:
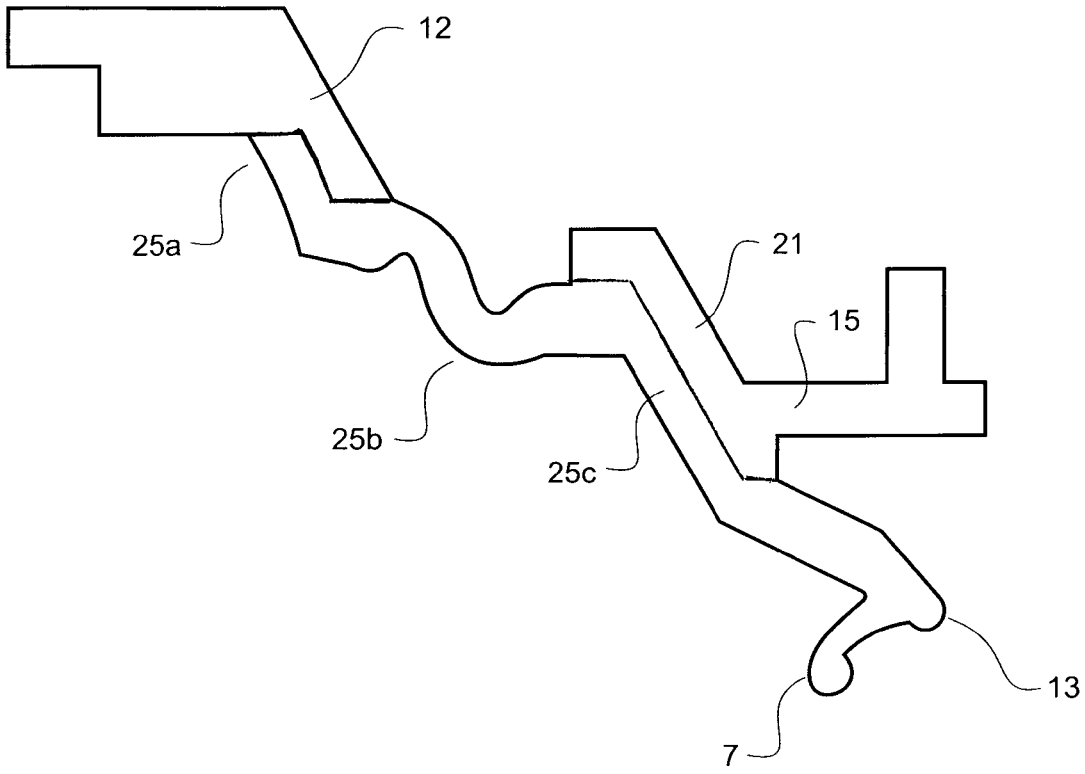
FIG. 8 shows detail of the preferred form of gasket and seal structure and part of the frame and lid centre, with a free or unattached body portion of the seal compressed and flexed as it would be for some of the time it is in use.

In use, as the tub 2 vibrates or shakes, the free body portion 25*b* is able to flex both horizontally and vertically to absorb the vibrations and maintain the seal. As the lid centre 5 is only connected to the frame 10 by the free body portion 25*b*, noise transmission and amplification from the tub 2 is minimised. Once the seal is formed (by the lips 7 and 13 on the tub 2), this seal is at least partially maintained during vibration of the tub 2 by the arrangement described above, where the flexing of the free body portion 25*b* has at least a partial horizontal component. The upper sealing lip 13 compresses vertically against the horizontal surface of the top edge 9, and the lower sealing lip 7 compresses against the horizontal surface of the wall of the tub 2. As the free body portion 25*b* on one side of the tub 2 is placed in compression by the tub wall pushing or vibrating against it, the bellows on the opposite side of the lid 3 is expanding. This helps to keep the lid 3 in position, as the forces that act on the lid 3 and tub 2 during use tend to balance and cancel out. The absorption of the vibrations also helps to dampen noise transmission from the tub 2 in use to the chassis 1. FIG. 8 shows detail of the gasket 25 and part of the frame 10 and lid centre 5, with the free body portion 25*b* compressed and flexed as it would be in use.

Generally, the flexing of the free body portion 25*b* to absorb vibration from the tub 2 in use is low amplitude flexing, and the free body portion 25*b* only flexes a small distance from its neutral or 'at rest' position, compressing or extending a small distance to maintain the seal. When the tub 2 is overloaded, the free body portion 25*b* is required to extend a greater amount to create the seal with the tub 2. It should be noted that 'flexing' as it is used in this specification refers to the free body portion 25*b* compressing and expanding in order to absorb vibration e.g. of the tub 2 in use, or similar small amplitude movement such as that required to create a good seal with the tub 2. 'Extending' is used in this specification to refer to the free body portion 25*b* being extended when the tub is overloaded—an extension that is at least an order of magnitude greater than flexing. Similarly, 'retraction' is used to indicate a return to the neutral position from an extended state.

It can be seen that when using the arrangement described above, the free body portion 25*b* is only required to extend when the tub 2 is overloaded. In contrast, some prior art arrangements require the extension of the seal carrier or a similar item every time the dishwasher is used. The arrangement described above reduces wear and fatigue of the gasket 25 and in particular the free body portion 25*b*, as extension is only required when the tub 2 is overloaded.

Local Stop

The preferred embodiment of the lid structure 3 is described above. If required, an additional item—a local stop 16—can be added to the lid assembly. This is described below with reference to FIG. 7.

The local stop 16 is a rigid item that acts as an extension to the lid centre 5. The local stop 16 is attached to the lid centre 5, and extends from the lid centre 5 towards the walls of the casing 1, over the top of the free body portion 25*b*. The function of the local stop 16 is to prevent the lid centre 5 from travelling too far downwards vertically. The upper surface of the free body portion 25*b* contacts the lower surface of the local stop 16 as the lid centre 5 descends, and prevents it from travelling any further downwards. In the preferred form, the outer perimeter edges of the local stop 16 overlap slightly over the top of the inner perimeter edges of the flat ledge portion 15, so that if the lid centre 5 'overpowers' the natural stiffness of the free body portion 25*b*, it will still be stopped from travelling downwards as it will contact the ledge portion 15. However, in order to realise the invention, it is generally sufficient that the local stop at least substantially overlaps the free body portion 25*b*. That part of the local stop 16 which extends from the edge of the lid centre 5 over the top of the free body portion 25*b* is generally planar. It should be noted that when 'stiffness' of the free body portion is referred to, it does not mean that the gasket 25 or the free portion 25*b* is rigid. The gasket 25 is a flexible rubber item. However, the thickness of the cross-section of the gasket 25 at the free portion 25*b* will allow it to support a certain amount of weight before it starts to flex or extend.

It should also be noted that it is not necessary for the local stop to be present to achieve the main benefits of the invention, although it is an available alternative embodiment.

Alternative Seal Location

As described above for the preferred and first alternative forms of FIGS. 3 to 7, the outer sealing portion 25*d* is an integral part of the gasket 25. It should be noted that in alternative forms, the outer sealing portion could be separate to the gasket, as shown in FIG. 9. Gasket 225 in this alternative arrangement is very similar to that described above for the preferred forms and the first alternative form, except that it does not include an outer sealing portion, just an inner portion 225*a*, a free portion 225*b*, and a frame connection portion 225*c*. The outer sealing portion 225*d* is connected separately to the frame 10 in this other alternative embodiment.

The invention claimed is:

1. An appliance comprising:

a casing, at least one open topped tub, located within said casing in use, a lid structure comprising:

a lid center portion, a frame circumscribing said lid center portion, a seal connected to said frame, a gasket connecting said lid center portion and said frame in such a manner that at least part of said gasket forms a free body portion between said frame and said lid center portion, and a lid structure supporting mechanism connecting said frame to said casing, wherein said lid structure supporting mechanism is configured to move said lid center portion and said frame downwardly, wherein said lid structure supporting mechanism is configured to move said frame downwardly until said seal forms a seal with a top edge of said tub to close and seal said tub in use, and wherein said free body portion of said gasket allows said frame to move further downwardly than said lid center portion if said lid center portion is prevented from further downward movement by an object located in said tub.

2. An appliance as claimed in claim 1 wherein said appliance is a dishwasher including a wash system for washing dishes contained therein, said casing having a front side with an opening formed therein, said dishwasher further including a tub support mechanism, supporting said tub and configured to allow said tub to move from a position where said tub is located fully within said casing, to a position where said tub is at least partially located outside said casing.

3. An appliance as claimed in claim 2 wherein said gasket includes an integral outer sealing portion which forms said seal in use.

4. An appliance as claimed in claim 3 wherein said outer sealing portion includes an upper sealing lip and a lower sealing lip.

5. An appliance as claimed in claim 2 wherein said seal is formed by an outer sealing portion that is separate from said gasket and is separately attached to said frame.

6. An appliance as claimed in claim 5 wherein said outer sealing portion includes an upper sealing lip and a lower sealing lip.

7. An appliance as claimed in claim 5 wherein said free body portion has a rectangular cross-section.

8. An appliance as claimed in claim 5 wherein said free body portion is formed as a bellows diaphragm.

9. An appliance as claimed in claim 3 wherein said free body portion has a rectangular cross-section.

10. An appliance as claimed in claim 3 wherein said free body portion is formed as a bellows diaphragm.

11. An appliance as claimed in claim 3 wherein said frame and said gasket are sized and connected such that said frame overlaps outside edges of said gasket, said frame including a ledge portion extending inwards, said frame connected to said gasket at least at said ledge portion.

12. An appliance as claimed in claim 11 wherein said lid structure also includes a frame stiffener, attached at or close to an outer part of said frame on at least one side of said frame, said frame stiffener formed as a u-channel section aligned sideways, with a base of said u-channel section covering the outermost part of said frame.

13. An appliance as claimed in claim 12 wherein said lid center portion is a flat rectangular plate that includes a downwards-facing perimeter edge wall angled outwards, and said gasket has the form of a hollow rectangle, said gasket connected to said lid center portion at said edge wall.

14. An appliance as claimed in claim 13 wherein said gasket and said outer sealing portion are made from silicon rubber.

15. An appliance as claimed in claim 13 wherein said gasket and said outer sealing portion are made from a thermoplastic elastomer.

16. An appliance as claimed in claim 15 wherein said frame includes a plurality of connection points adapted to connect said frame to said lid structure supporting mechanism in use.

17. An appliance as claimed in claim 14 or claim 15 wherein said lid structure also includes a local stop, connected to and extending outwards from said lid center portion, the outer part of said local stop overlapping above at least a portion of said gasket.

18. An appliance as claimed in claim 17 wherein said lid structure portion includes a sound deadener.

19. An appliance as claimed in claim 5 wherein said frame and said gasket are sized and connected such that said frame overlaps outside edges of said gasket, said frame including a ledge portion extending inwards, said frame connected to said gasket at least at said ledge portion.

20. An appliance as claimed in claim 19 wherein said lid structure also includes a frame stiffener, attached at or close to an outer part of said frame on at least one side of said frame, said frame stiffener formed as a u-channel section aligned sideways, with a base of said u-channel section covering the outermost part of said frame.

21. An appliance as claimed in claim 20 wherein said lid center portion is a flat rectangular plate that includes a downwards-facing perimeter edge wall angled outwards, and said gasket has the form of a hollow rectangle, said gasket connected to said lid center portion at said edge wall.

22. An appliance as claimed in claim 21 wherein said gasket and said outer sealing portion are made from silicon rubber.

23. An appliance as claimed in claim 21 wherein said gasket and said outer sealing portion are made from a thermoplastic elastomer.

24. An appliance as claimed in claim 23 wherein said frame includes a plurality of connection points adapted to connect said frame to said lid structure supporting mechanism in use.

25. An appliance as claimed in claim 22 or claim 23 wherein said lid structure also includes a local stop, connected to and extending outwards from said lid center portion, the outer part of said local stop overlapping above at least a portion of said gasket.

26. An appliance as claimed in claim 25 wherein said lid structure includes a sound deadener.

* * * * *